US005964681A

United States Patent [19]

Stevens

[11] Patent Number: 5,964,681

[45] Date of Patent: Oct. 12, 1999

[54] TREADMILL EXERCISE DEVICE

[76] Inventor: Clive Graham Stevens, 372 Hills Borough Road, Auckland, New Zealand

[21] Appl. No.: 08/884,745

[22] Filed: Jun. 30, 1997

[51] Int. Cl.[6] ..... A63B 23/00

[52] U.S. Cl. ..... 482/54; 482/51

[58] Field of Search ..... 482/51, 54

[56] References Cited

U.S. PATENT DOCUMENTS 5,088,729 2/1992 Dalebout ..... 482/54

5,476,430 12/1995 Lee et al. ..... 482/54

*Primary Examiner*—Glenn E. Richman

*Attorney, Agent, or Firm*—Norman E. Lehrer

[57] ABSTRACT

A treadmill exercise device includes two side frames with a plurality of connecting bars connected therebetween. A board is disposed onto the two side frames. Two first supports are respectively disposed to two respective first ends of the two side frames and two second supports are respectively disposed to two respective second ends of the two side frames. A first roller is rotatably disposed between the two first supports and a second roller is rotatably disposed between the two second supports so that a belt is movably wrapped around the two rollers with the board disposed therebelow.

4 Claims, 4 Drawing Sheets

TREADMILL EXERCISE DEVICE

BACKGROUND OF THE INVENTION

1. Field of the Invention

The present invention relates to an exercise device and, more particularly, to a treadmill exercise device having a better structural strength and an adjusting device which is easily to be operated to adjust a tensile force of the belt.

2. Brief Description of the Prior Art

A conventional treadmill exercise device includes two side frames between which two rollers are separately and rotatably disposed, an endless belt wrapped around the two rollers so that a user can run on the belt. In order to support the user's weight during using the treadmill exercise device, a board is inserted between the two side frames and the belt. However, a certain thickness and stiffness of the board are required so as to sufficiently support the user's weight. The board increases a total weight of the treadmill exercise device.

The present invention intends to provide an improved treadmill exercise device to mitigate and/or obviate the above-mentioned problems.

SUMMARY OF THE INVENTION

The present invention provides a treadmill exercise device comprising two side frames each having two open ends and a plurality of connecting bars connected transversely between the two side frames. Two first supports are respectively and fixedly connected to two respective first ends of the two side frames and two second supports are respectively and fixedly connected to two respective second ends of the two side frames so that a first roller and a second roller are respectively and rotatably disposed between the first and the second supports. A board is disposed onto the two side frames and a belt is wrapped around the two rollers with the board being disposed below the belt.

It is an object of the present invention to provide a treadmill exercise device having connecting bars connected between the two side frames so as to enforce a structural strength thereof.

It is another object of the present invention to provide an adjusting device which is easy to adjust a tensile force of the belt.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
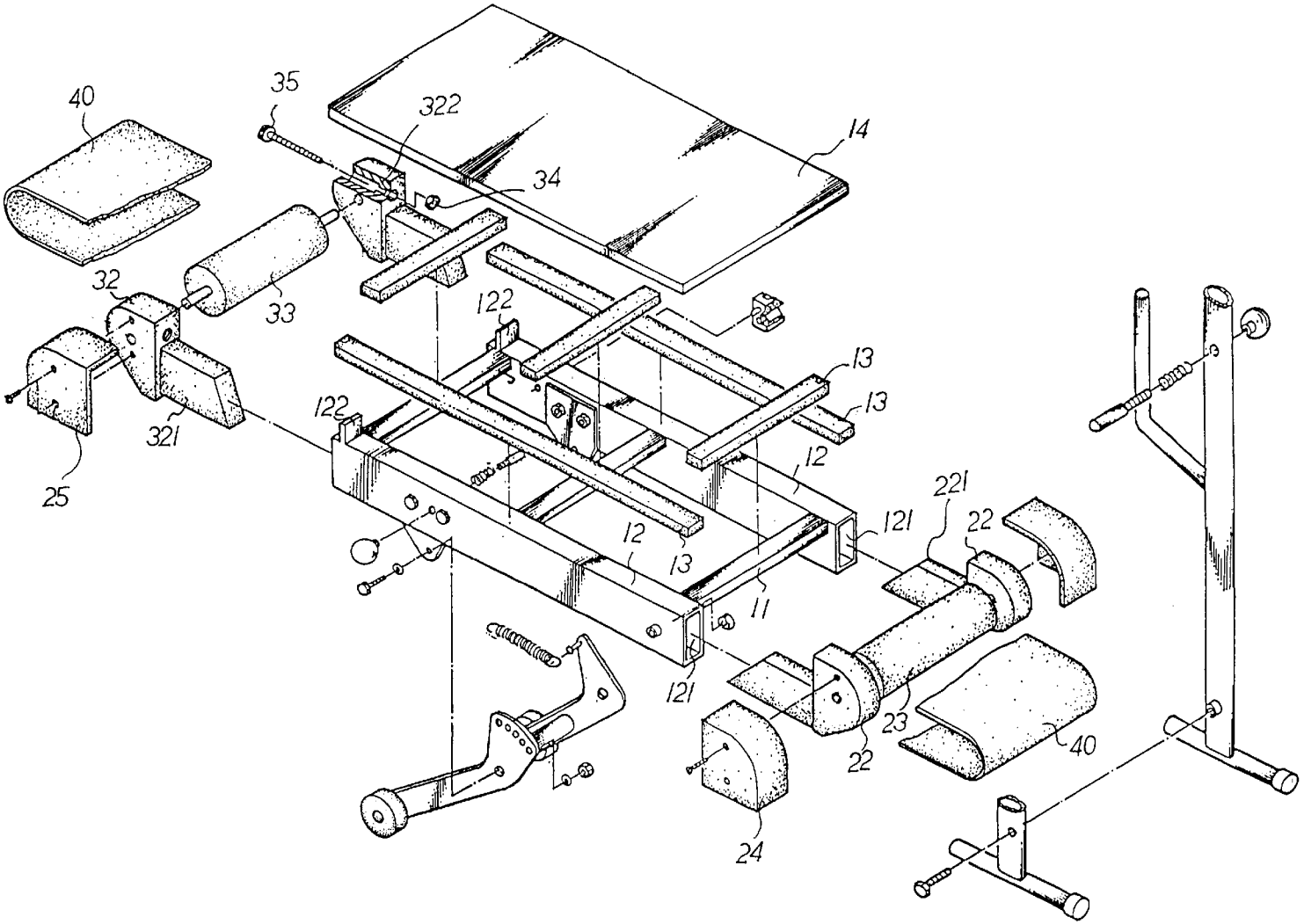
FIG. 1 is an exploded view of a treadmill exercise device in accordance with the present invention.
Figure 2:
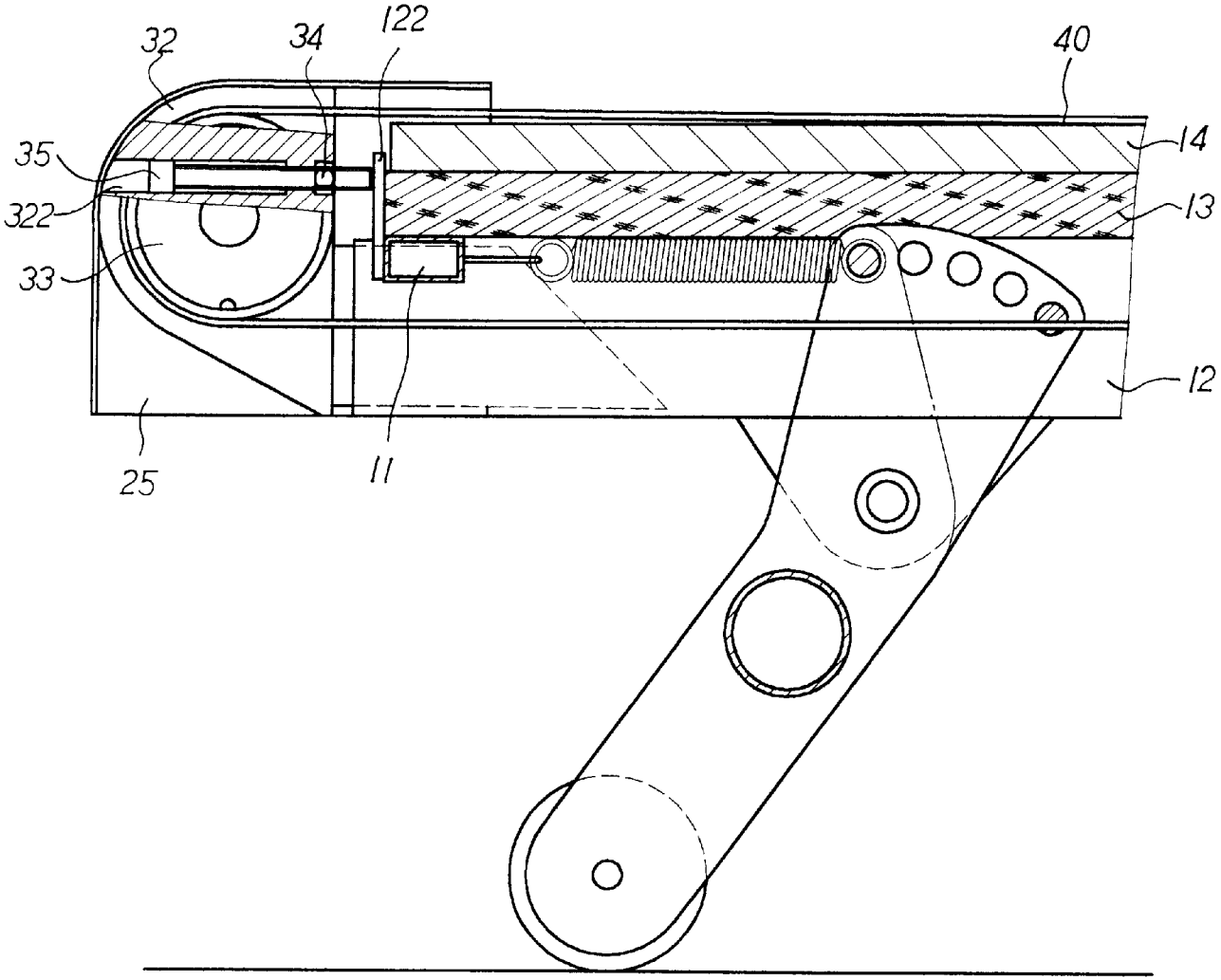
FIG. 2 is a side elevational view, partly in section, of an adjusting device when not being operated yet.

Referring to the drawings and initially to FIGS. 1 and 2, a treadmill exercise device in accordance with the present invention generally includes two side frames 12 each having two open ends 121, a plurality of connecting bars 11 connected transversely between the two side frames 12 so as to have an enforce structural strength. Each of the side frames 12 and connecting bars 11 has a soft pad 13 disposed on an upper side thereof. A board 14 is disposed onto the two side frames 12.

Two first supports 22 each have an insert portion 221 extending therefrom so as to be fixedly inserted into the corresponding open end 121 of a first end of the side frames 12. Each of the first supports 22 has an outer casing 24 fixedly disposed thereto. A first roller 23 is rotatably disposed between the two first supports 22. Two second supports 32 each have an insert portion 321 extending therefrom so as to be fixedly inserted into the corresponding open end 121 of a second end of the side frames 12. Each of the second supports 32 has an outer casing 25 fixedly disposed thereto. A second roller 33 is rotatably disposed between the two second supports 32. The second end of each of the side frames 12 has a stop 122 extending from the upper side thereof.

Each of the two second supports 32 have an adjusting device disposed thereto which comprises a passage 322 defined through each of the two second supports 32 so that two bolts 35 respectively extend through the passages 322 and are engaged with respective nuts 34 received in the passages 322. Each of the bolts 35 contacts the corresponding stop 122. A belt 40, preferable an endless belt, is wrapped around the two rollers 23, 33 with the board 14 being disposed below the belt 40.

Figure 3:
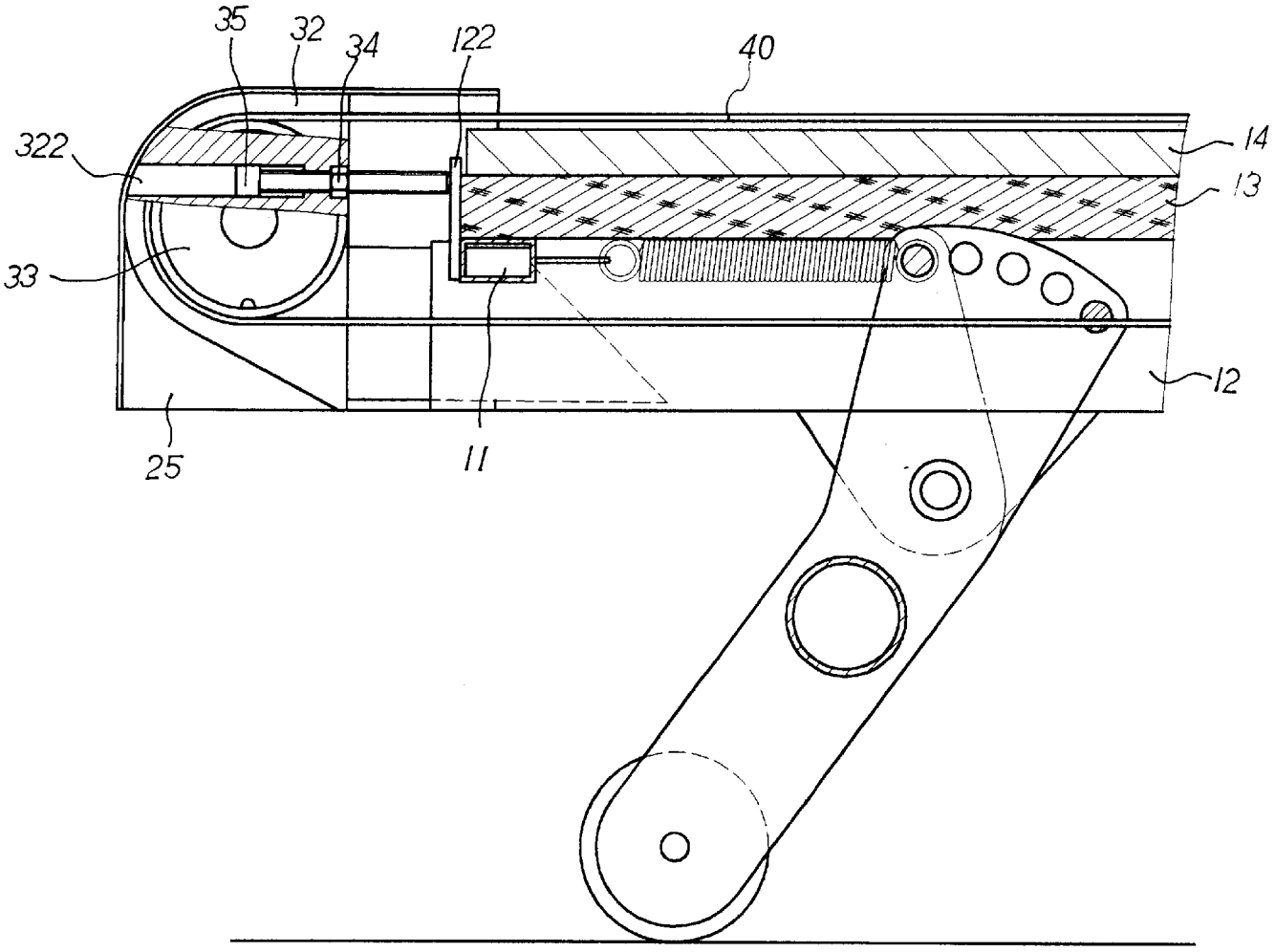
FIG. 3 is a side elevational view, partly in section, of an adjusting device when being operated to increase a distance between the second supports and the side frames.
Figure 4:
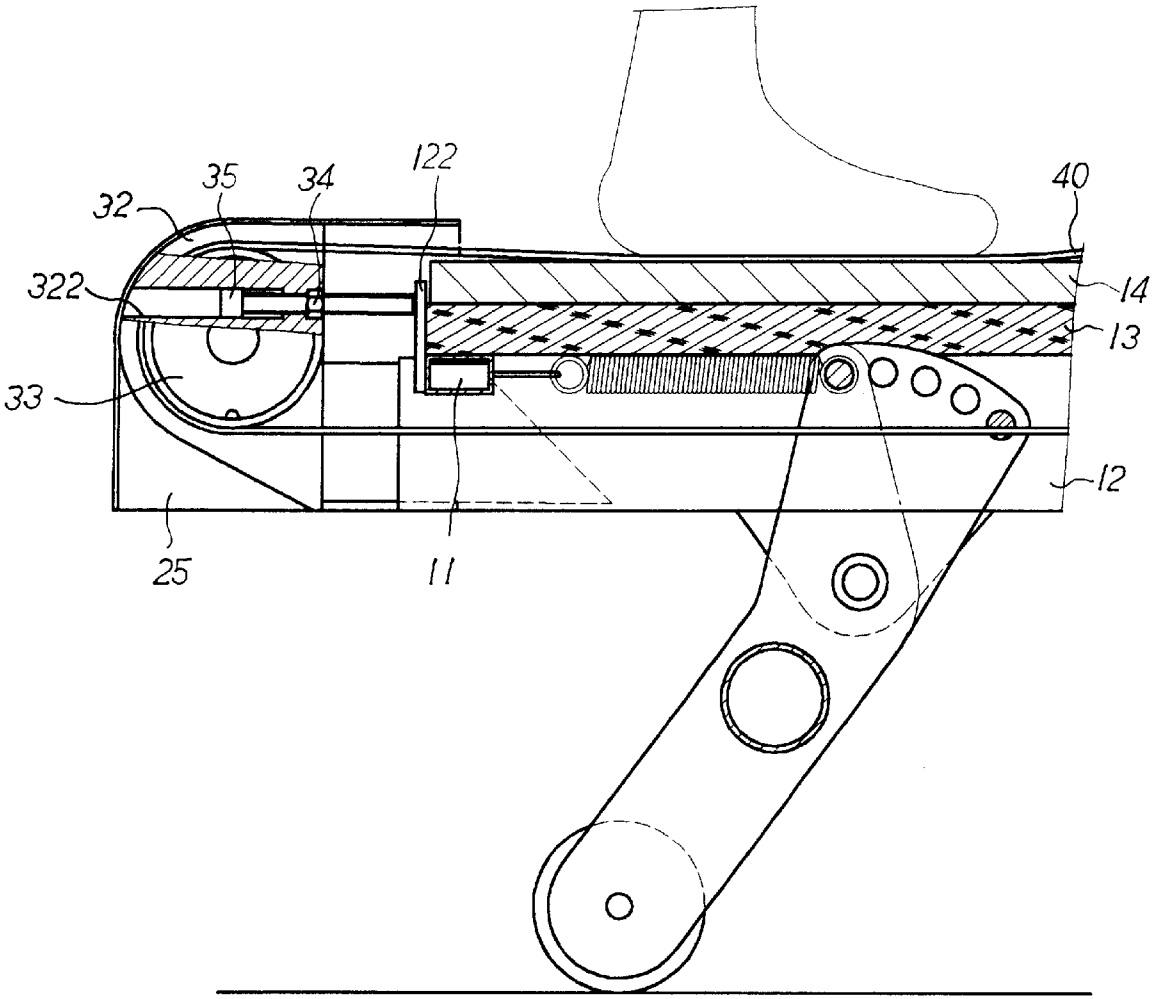
FIG. 4 is a side elevational view, partly in section, of the treadmill exercise device wherein a user's foot is on the belt.

Referring to FIG. 3, when a tensile force of the belt 40 is needed to be adjusted, a user (not shown) rotates the bolts 35 toward the stops 122 so as to increase a distance between the second supports 32 and the side frames 12, the tensile force of the belt 40 is therefore adjusted to a desired level. Referring to FIG. 4, the user's runs on the belt 40 with his/her feet (only one is shown) and a reaction force from the board 14 is partially absorbed by the soft pads 13 so that the user feel comfortable when running on the belt 40.

Accordingly, the connecting bars 11 enforce the strength of the structure of the treadmill exercise device so that the board 14 needs only a thin thickness and the weight of the device is therefore reduced. In addition, the adjusting device is easily to be operated so that any users can handle the adjusting device.

Although the invention has been explained in relation to its preferred embodiment, it is to be understood that many other possible modifications and variations can be made without departing from the spirit and scope of the invention as hereinafter claimed.

What is claimed is:

1. A treadmill exercise device comprising:

two side frames each having two open ends, a plurality of connecting bars connected transversely between said two side frames;

two first supports respectively and fixedly connected to two respective first ends of said two side frames and two second supports respectively and fixedly connected to two respective second ends of said two side frames so that a first roller and a second roller are respectively and rotatably disposed between said first and said second supports;

a board disposed onto said two side frames;

a belt wrapped around said two rollers with said board being disposed below said belt, and wherein said second end of each of said side frames has a stop extending from said upper side thereof and each of said two second supports has a passage defined therethrough so that two bolts respectively extend through said passages and are engaged with respective nuts received in said passages and contact said respective stops.

2. The treadmill exercise device as claimed in claim 1 wherein each of said side frames and connecting bars has a soft pad disposed on an upper side thereof.

3. The treadmill exercise device as claimed in claim 1 wherein each of said first and said second supports has an insert portion inserted into said corresponding open end of said side frames.

4. The treadmill exercise device as claimed in claim 1 wherein said belt is an endless belt.

* * * * *